US011464690B2

(12) United States Patent
Dobbs et al.

(10) Patent No.: US 11,464,690 B2
(45) Date of Patent: Oct. 11, 2022

(54) POSTURALLY SUPPORTIVE TOILET SEAT APPARATUS

(71) Applicant: James Lecky Design Limited, Lisburn (GB)

(72) Inventors: Colm Dobbs, Lisburn (GB); Laura Finney, Lisburn (GB); David Turner, Lisburn (GB)

(73) Assignee: James Lecky Design Limited, Lisburn (GB)

( * ) Notice: Subject to any disclaimer, the term of this patent is extended or adjusted under 35 U.S.C. 154(b) by 30 days.

(21) Appl. No.: 17/030,691

(22) Filed: Sep. 24, 2020

(65) Prior Publication Data

US 2021/0085543 A1 Mar. 25, 2021

(30) Foreign Application Priority Data

Sep. 25, 2019 (GB) ..... 1913805

(51) Int. Cl.

| | |
|---|---|
| ***A61G 5/12*** | (2006.01) |
| ***A61G 5/10*** | (2006.01) |
| ***A47K 11/04*** | (2006.01) |
| ***A47K 13/00*** | (2006.01) |
| ***A47K 13/10*** | (2006.01) |

(Continued)

(52) U.S. Cl.

CPC ..... *A61G 5/1002* (2013.01); *A47K 11/04* (2013.01); *A47K 13/005* (2013.01); *A47K 13/10* (2013.01); *A47K 17/028* (2013.01); *A61G 5/128* (2016.11); *A47K 13/06* (2013.01)

(58) Field of Classification Search

CPC ..... A61G 5/1002; A61G 5/128; A47K 11/04; A47K 17/028; A47K 17/02

USPC ..... 4/237, 480, 483

See application file for complete search history.

(56) References Cited

U.S. PATENT DOCUMENTS

| | | | |
|---|---|---|---|
| 1,062,704 | A | 5/1913 | Greenwood |
| 1,296,901 | A | 3/1919 | Adee |
| 2,518,272 | A | 8/1950 | Beckwith |

(Continued)

FOREIGN PATENT DOCUMENTS

WO 2018152187 A1 8/2018

OTHER PUBLICATIONS

Search Report dated Feb. 12, 2021 in corresponding European Application No. 20198213.9.

(Continued)

*Primary Examiner* — Huyen D Le

(74) *Attorney, Agent, or Firm* — Vitale Vickrey Niro & Gasey

(57) ABSTRACT

A posturally supportive toilet seat apparatus 1 comprising a seat 10 having a base portion 11. The base portion has leg support features 12 and an aperture 13 formed therein for passage of waste therethrough. The apparatus 10 further comprises a back support 14 which extends from a rear end of the base portion 11. The back support 14 and leg support features 12 are shaped, dimensioned, and, in an in use-configuration, adjustable/positionable relative to each other in an oblique relationship. In the in-use configuration, the thighs and torso of a user seated on the seat 10 are encouraged to form an acute interior angle therebetween, with knees locatable above hips, essentially resulting in the user adopting a squat position.

20 Claims, 9 Drawing Sheets

(51) Int. Cl.
*A47K 17/02* (2006.01)
*A47K 13/06* (2006.01)

(56) References Cited

U.S. PATENT DOCUMENTS

| | | | | |
|---|---|---|---|---|
| 3,258,291 | A | 6/1966 | Zacharie | |
| 4,654,904 | A * | 4/1987 | Britz | A61G 5/00 297/411.26 |
| 5,944,338 | A * | 8/1999 | Simpson | A61G 5/006 280/650 |
| 5,974,598 | A | 11/1999 | Granda-Cabrera | |
| 2006/0261660 | A1* | 11/2006 | Lingegard | A61G 5/1059 297/423.26 |
| 2007/0220665 | A1 | 9/2007 | Deutsch | |
| 2019/0069733 | A1* | 3/2019 | Rife | G01G 19/52 |

OTHER PUBLICATIONS

Search Report dated Feb. 28, 2020 in corresponding application GB1913805.6.

* cited by examiner

POSTURALLY SUPPORTIVE TOILET SEAT APPARATUS

FIELD OF THE INVENTION

This invention relates to a posturally supportive toilet seat apparatus and in particular to a posturally supportive toilet seat apparatus for use by users with a disability.

BACKGROUND OF THE INVENTION

Squatting is a proven superior physiological method for bladder and bowel evacuation and is adopted by approximately 50% of the world's population. It is a recognised and recommended approach to aid constipation within Western cultures. Toileting for individuals, and in particular children, with neurological and physical disabilities or complex developmental delays is often hindered by atypical muscle tone, strength and control. This means that children with disabilities often cannot, or struggle to, self-initiate voluntary muscles within the pelvic floor muscle group and abdomen that facilitate bladder and bowel evacuation. Children with disabilities are more at risk and prone to dysfunctional bladders, constipation and urinary tract and bowel infections. This is a direct result of impaired mobility, the inability to effectively empty the bladder and bowels and as a consequence of medications, NG or PEG feeding and restricted fluid or fibre intake. Defecation is traditionally assisted by the Valsalva manoeuvre and contraction of the abdomen and pelvic diaphragm to exert pressure on the digestive tract. This helps allow stool to pass through the kink (anorectal angle) in the passage between the rectum and anus. Squatting however, enables the natural descent of the pelvic floor muscles without straining, relaxing the puborectalis muscle that chokes the anal canal to maintain continence and allowing the kink between rectum and anus to straighten allowing stool to pass more freely and bowel evacuation to occur with limited strain.

Carers, parents, or medical professionals tasked with facilitating the toileting needs of children with disabilities, often utilise specially adapted bathroom facilities which comprise in-built infrastructure designed to encourage a user into a squatted position. This is satisfactory when close to such facilities, but when this is not the case it is often difficult to facilitate adequate toileting as such facilities are not portable. Moreover, existing infrastructure exhibits minimal adjustability such that a user may not continue to use it even should their anatomy change, for example due to growth.

It is desirable to provide a posturally supportive toilet seat apparatus which is both adaptable and portable such that it may be used in a variety of settings and by users of differing anatomy/size.

SUMMARY OF THE INVENTION

According to the invention there is provided a posturally supportive toilet seat apparatus comprising: a seat, the seat comprising a base portion, the base portion comprising leg support means and having an aperture formed therein; back support means; wherein the back support means and leg support means are shaped, dimensioned, and/or adjustable/positionable relative to each other in an oblique relationship such that, in an in use configuration, the thighs and torso of a user seated on the seat are encouraged to form an acute interior angle therebetween with knees locatable above hips, resulting in the user adopting a squat position.

Advantageously, the relative positioning of the back support means and leg support means contributes to the positioning of a user in the squat position which aids bowel evacuation.

Preferably, the back support means and leg support means are shaped, dimensioned, and/or adjustable/positionable relative to each other in an oblique relationship such that at least a portion of said back support means and leg support means form an acute interior angle therebetween defining a user receiving area.

Ideally, the leg support means comprise thigh support portions shaped and dimensioned to support the thighs of a user seated on the seat.

Preferably, the apparatus comprises a foot support element configured to support the feet of a user seated on the seat.

Ideally, the posturally supportive toilet seat apparatus further comprises lateral side support means which extend from the base portion and are shaped and dimensioned to laterally support a user seated on the seat.

Preferably, the seat comprises a stowed configuration wherein the back support means is folded towards the leg support means such that the back support means extends generally over an upper surface of the base portion.

Ideally, in the stowed configuration, the lateral side support means are foldable towards the upper surface of the base portion.

Preferably, the seat is deployable between the in use and stowed configurations.

Preferably, the base portion, back support means, and/or the leg support means comprise contoured user facing surfaces shaped such that the anatomy of a user is supported in the squat position.

Ideally, the thigh support portions comprise inner and outer thigh support surfaces shaped and dimensioned to support respective inner and outer thighs of a user.

Preferably, an adjustment mechanism is operable to adjust the positioning of the back support means relative to the leg support means.

Ideally, the back support means and/or leg support means are independently adjustable/positionable.

Preferably, each lateral side of the back support means is independently adjustable/positionable relative to the leg support means.

Ideally, the seat is mountable on a supporting frame.

Preferably, the frame comprises means for vertical adjustment.

Ideally, the seat is slidably mountable to the frame such that the seat is slidable in forward and rearward directions.

Preferably, the frame comprises a collection pan removably mountable to the frame such that the collection pan is mountable beneath the aperture of the seat.

Ideally, the frame is deployable between an in use configuration and a stowed configuration.

Preferably, the foot support element is movably mountable to the frame such that the distance between an underside of the seat and the foot support element is adjustable.

According to a second aspect of the invention there is provided a frame for a posturally supportive toilet seat apparatus, a seat being movably mountable to the frame.

According to a third aspect of the invention there is provided a posturally supportive toilet seat kit comprising: a posturally supportive toilet seat comprising: a seat, the seat comprising a base portion, the base portion comprising leg support means and having an aperture formed therein; back support means; wherein the back support means and leg support means are shaped, dimensioned, and/or adjustable/ positionable relative to each other in an oblique relationship such that, in an in use configuration, the thighs and torso of a user seated on the seat are encouraged to form an acute interior angle therebetween with knees locatable above hips, resulting in the user adopting a squat position; the kit further comprising: a frame, the seat being mountable to the frame.

Ideally, the kit further comprises a collection pan removably mountable to the frame.

Preferably, the Kit further comprises a changing mat configured for changing/cleaning of the user.

BRIEF DESCRIPTION OF THE DRAWINGS

An embodiment of the invention is now described by way of example and with reference to the accompanying drawings in which.

DETAILED DESCRIPTION OF THE DRAWINGS

The present teaching will now be described with reference to an exemplary posturally supportive toilet seat apparatus. It will be understood that the exemplary posturally supportive toilet seat apparatus is provided to assist in an understanding of the present teaching and are not to be construed as limiting in any fashion. Furthermore, elements or components that are described with reference to any one Figure may be interchanged with those of other Figures or other equivalent elements without departing from the spirit of the present teaching.

Figure 7:
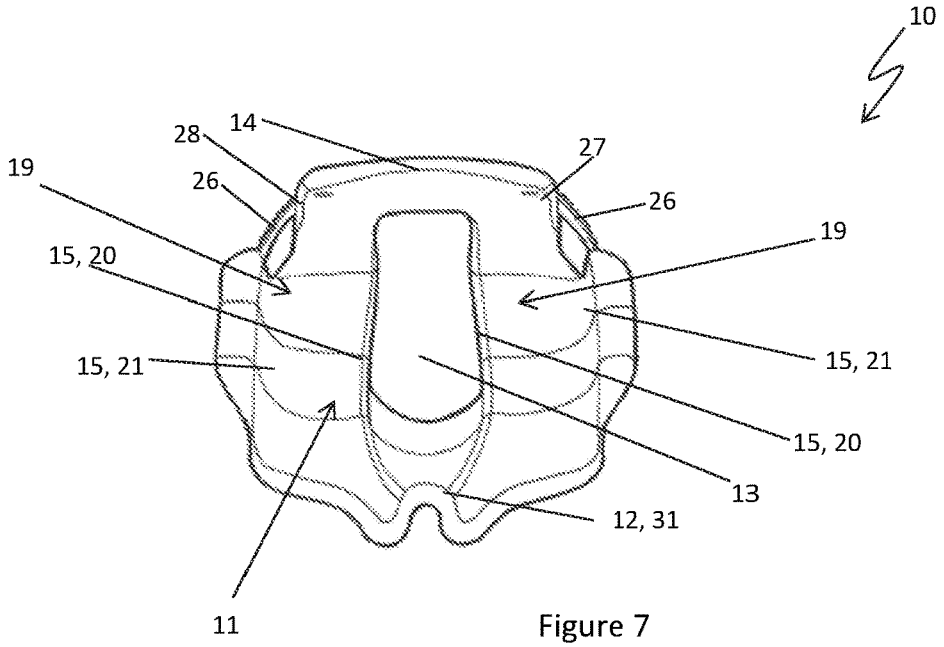
FIG. 7 is a plan view of a seat of a posturally supportive toilet seat apparatus in an in-use configuration.

Referring now to the Figures there is illustrated a posturally supportive toilet seat apparatus 1 comprising a seat 10 having a base portion 11. The base portion has leg support features 12 and an aperture 13 formed therein for passage of waste therethrough. The aperture may additionally provide access to the buttocks for a parent, carer, or medical professional should a user require assistance in this area. The base portion and leg support features 12 may form a continuous integral component or a multi-component arrangement as can be seen in FIG. 7. The leg support features 12 are formed by extensions or curvatures of the base portion 11. In alternative embodiments, the leg support portions 12 may be attachable to the base portion 11.

Figure 1:
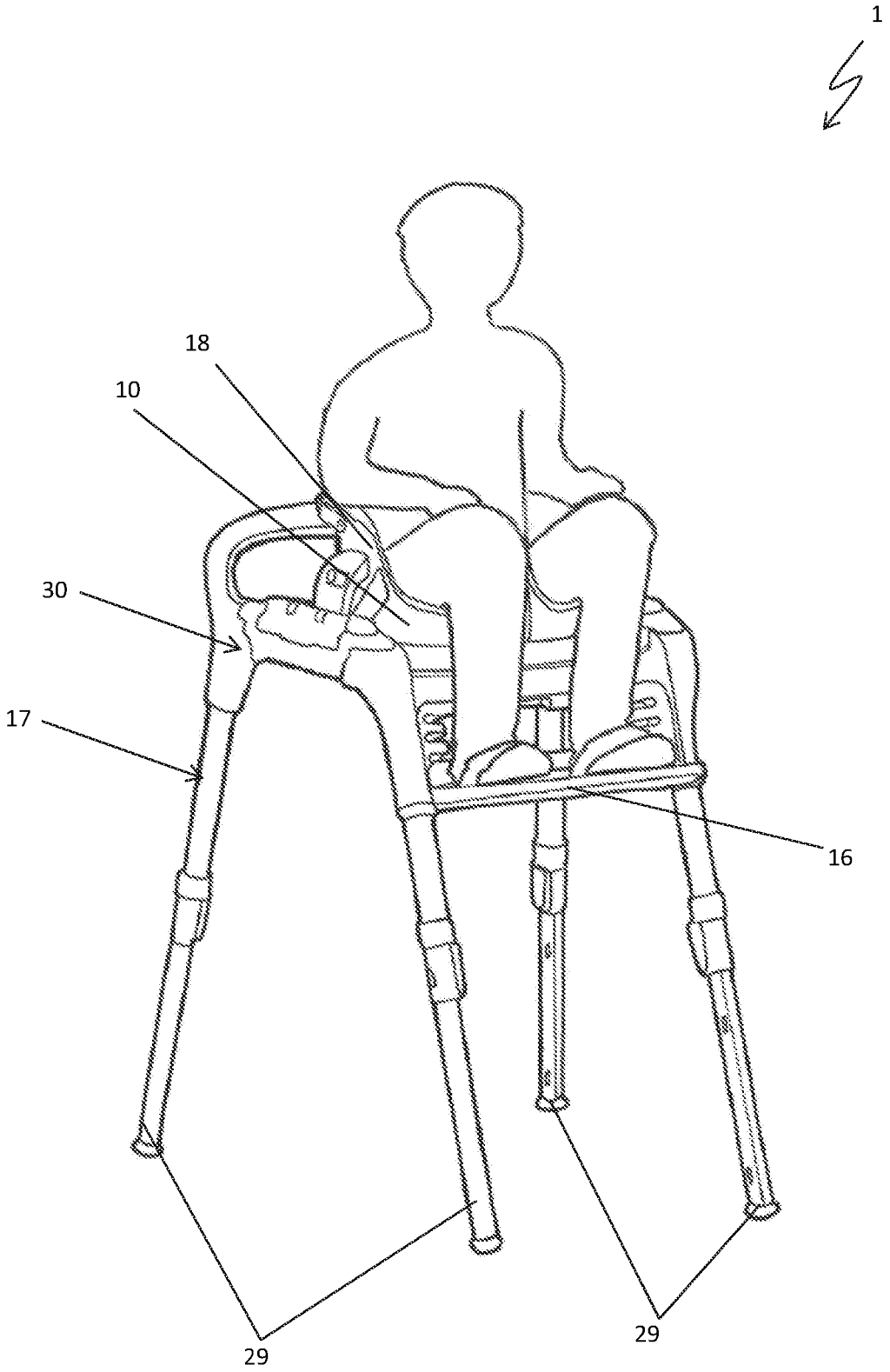
FIG. 1 is a perspective view of a posturally supportive toilet seat apparatus showing a user seated thereon.
Figure 2:
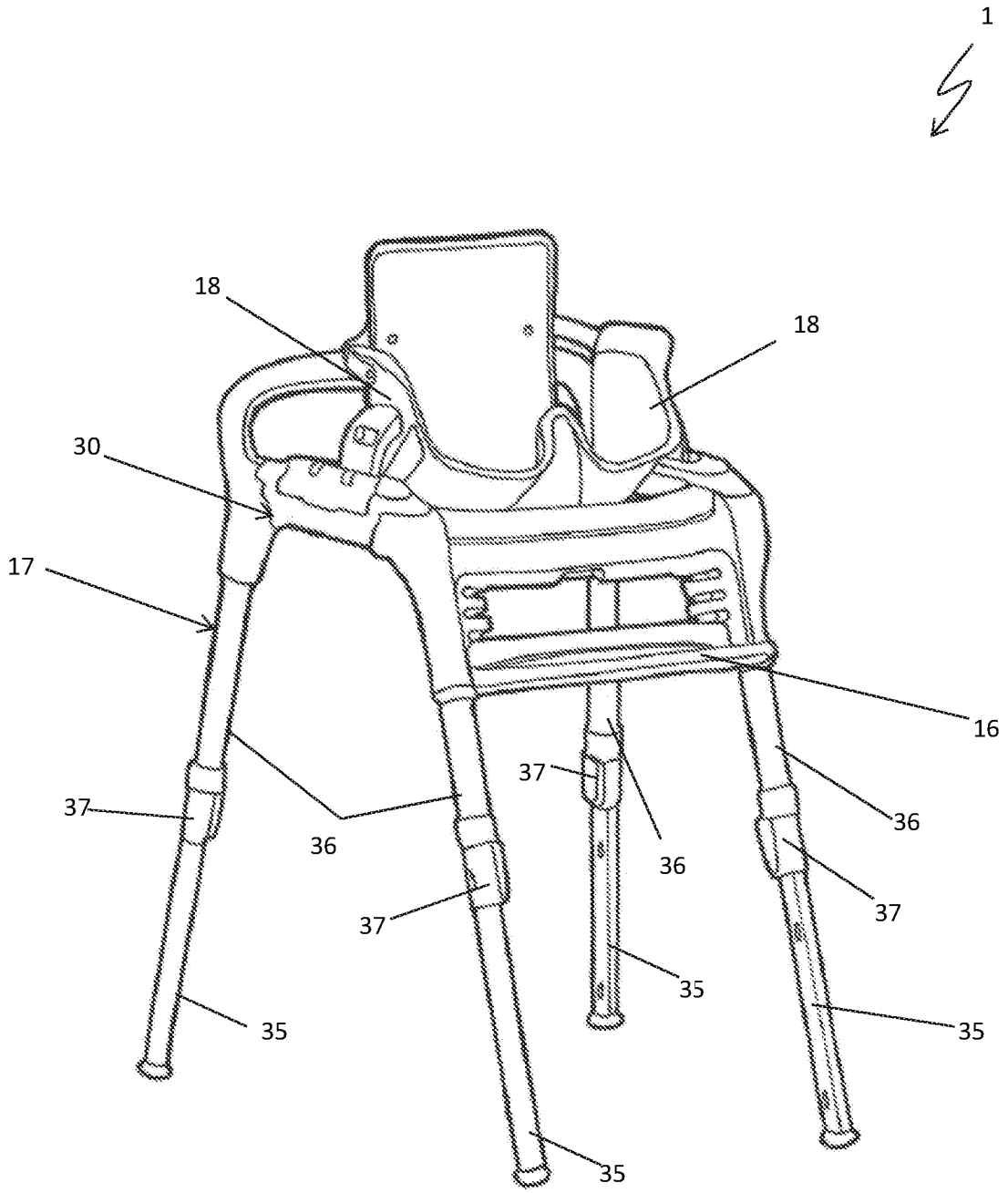
FIG. 2 is a perspective view of a posturally supportive toilet seat apparatus.
Figure 3:
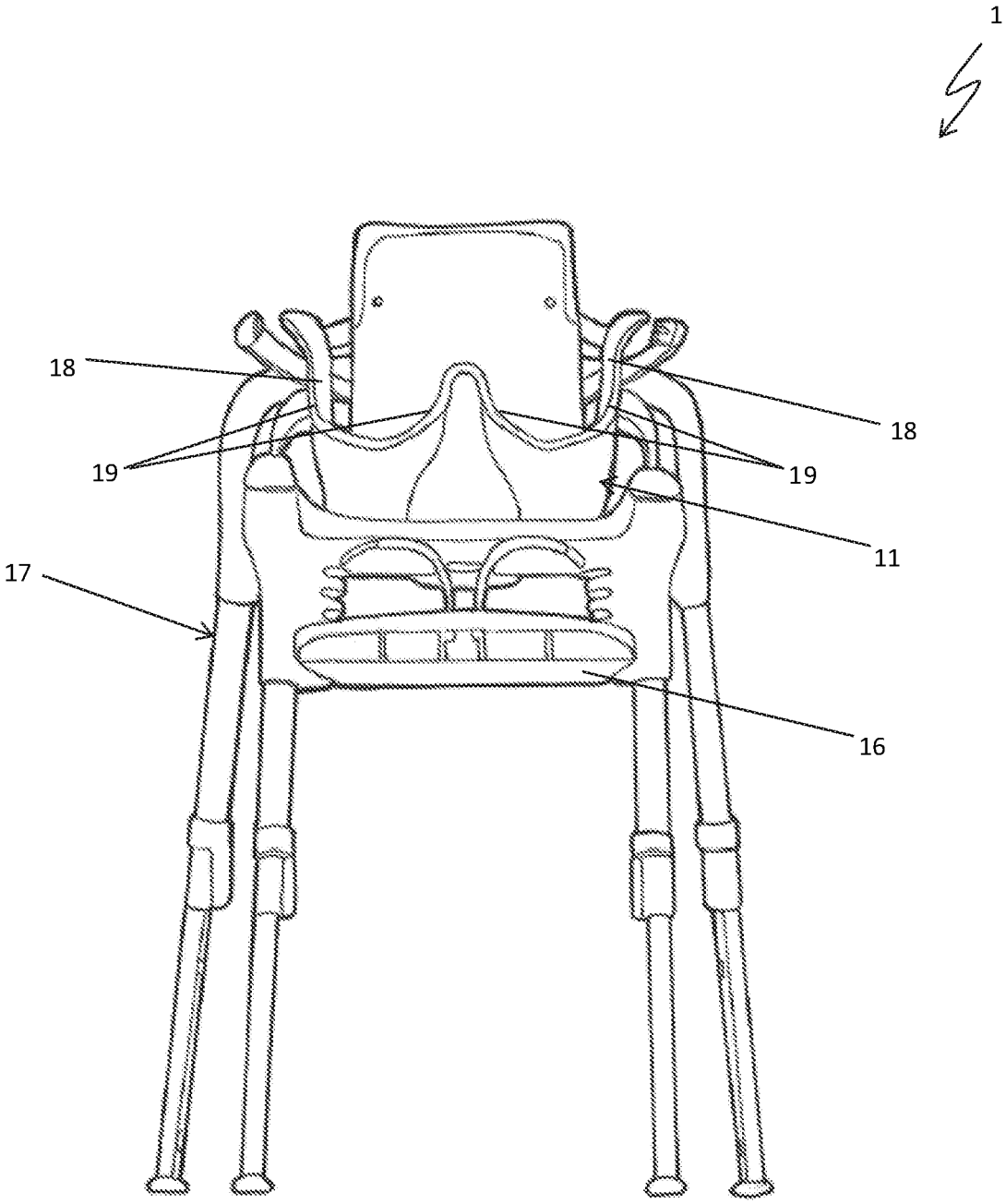
FIG. 3 is a front view of a posturally supportive toilet seat apparatus.
Figure 4:
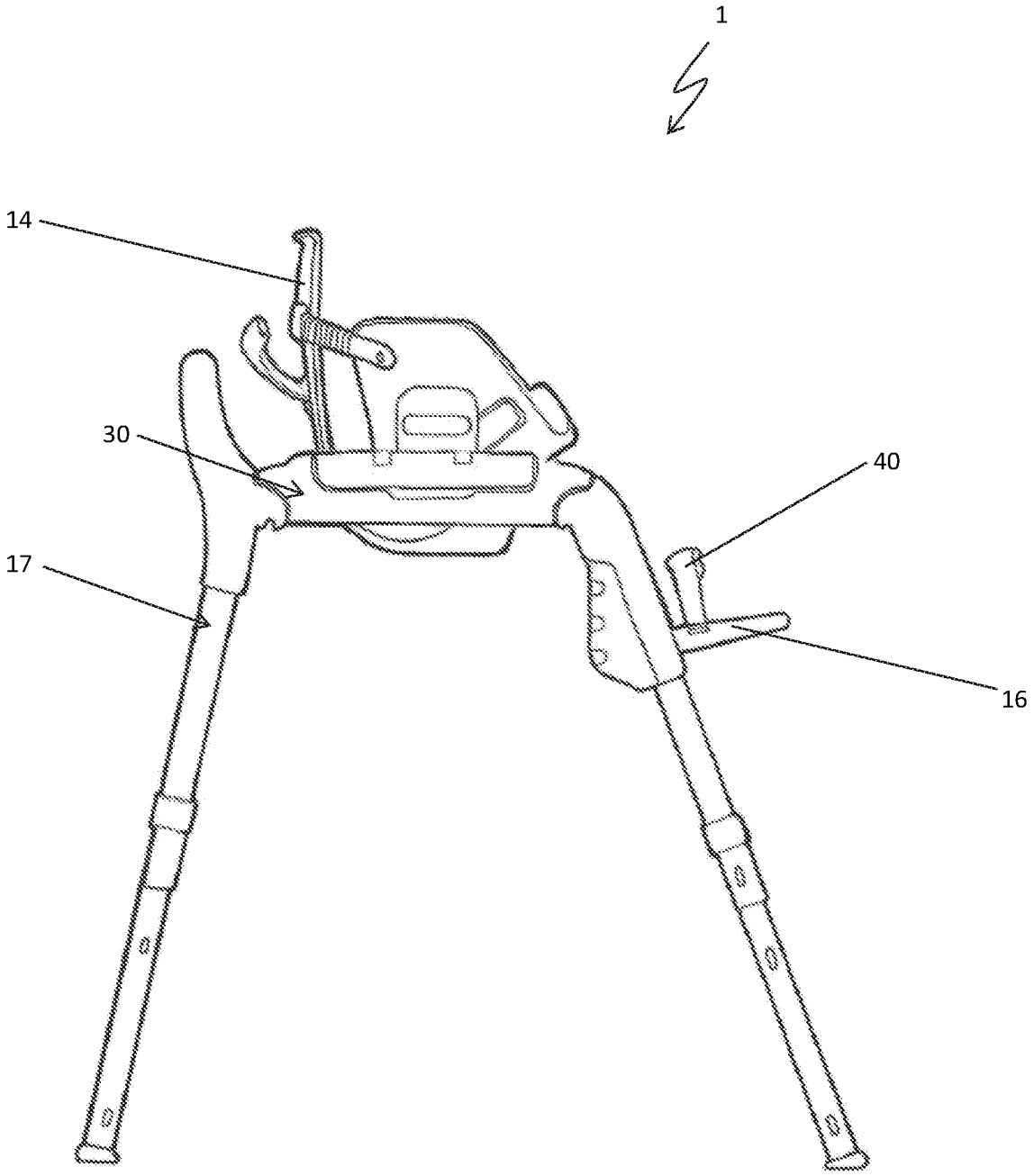
FIG. 4 is a side view of a posturally supportive toilet seat apparatus.
Figure 5:
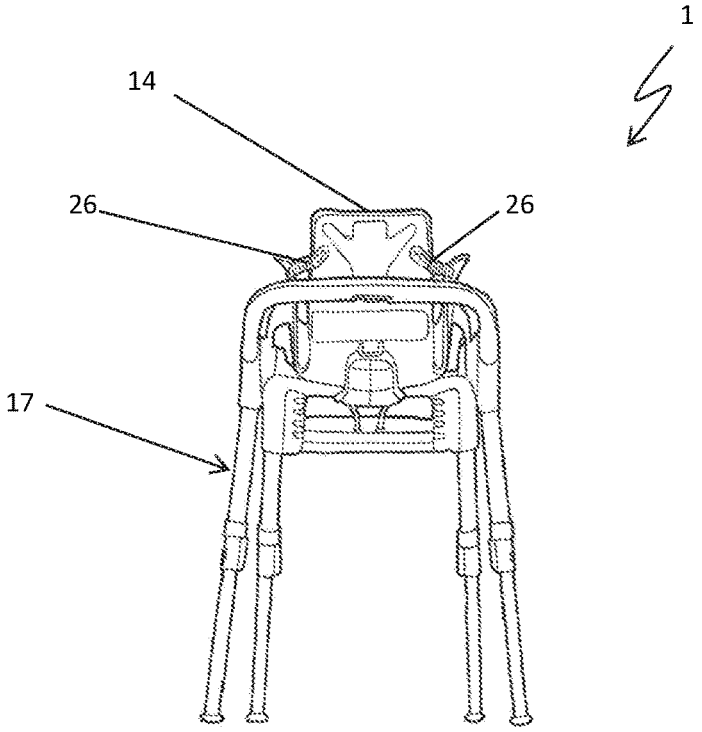
FIG. 5 is a rear view of a posturally supportive toilet seat apparatus.
Figure 6:
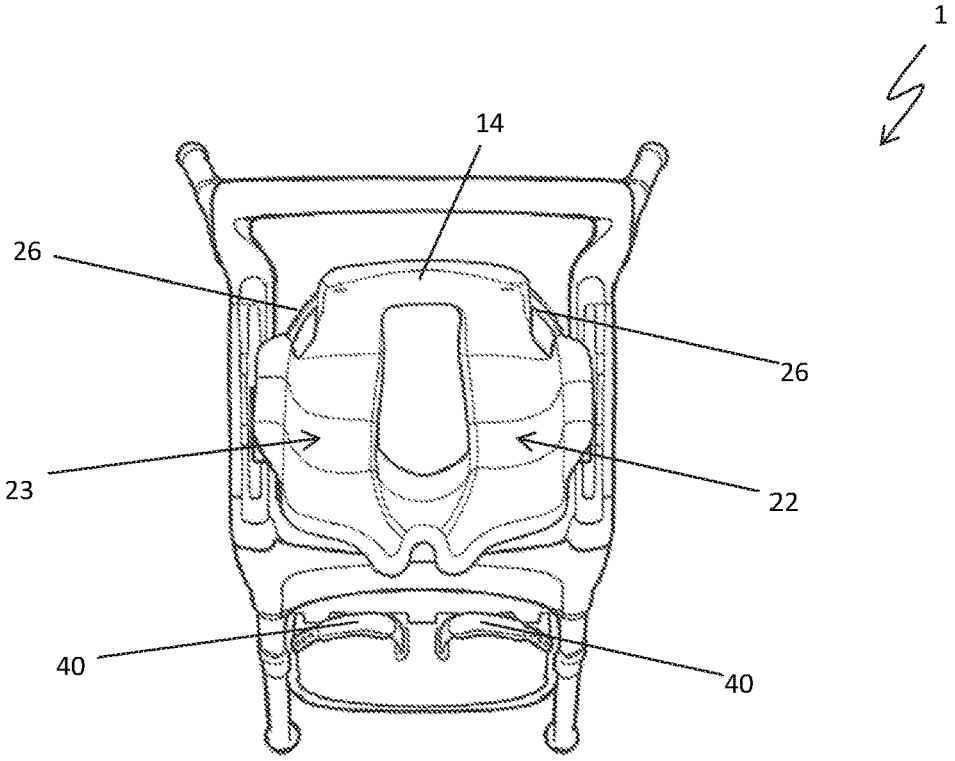
FIG. 6 is a plan view of a posturally supportive toilet seat apparatus.
Figure 8:
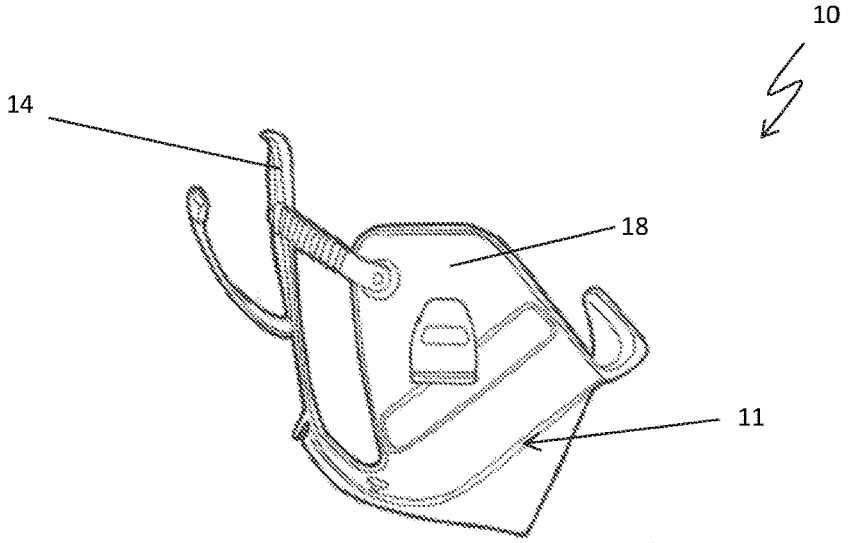
FIG. 8 is a side view of a seat of a posturally supportive toilet seat apparatus in an in-use configuration.

The apparatus 10 further comprises a back support 14 which extends from a rear end of the base portion 11. The back support 14 and leg support features 12 are shaped, dimensioned, and, in an in use-configuration, adjustable/positionable relative to each other in an oblique relationship as can be seen in FIG. 8. In the in-use configuration, the thighs and torso of a user seated on the seat 10 are encouraged to form an acute interior angle therebetween, as demonstrated in FIG. 1, with knees locatable above hips, essentially resulting in the user adopting a squat position. More specifically, the squat position encouraged by the apparatus 10 results in the heels of a user being raised to a position closer to the buttocks by the bending of the knees. This position is not only clinically proved to ease voiding/defecation, but also places the weight of the head and trunk of a user over a base of support which is advantageous where the user suffers from muscle issues resulting in difficulty sustaining positioning of the head and trunk. Flexing the joints, as is encouraged by the apparatus 10, is also a clinically recognised method of dulling the effect of high tone in muscles. In a squatted position with knees above hips and trunk leant forward, the spine loses the lordotic curve at the lumbar, and the pelvis posteriorly tilts backwards. This causes the lumbar to flatten out and enable the whole spine to take on a C-shaped curve (Kyphosis). This is the optimal physiological position and posture to facilitate bowel movements. The back support 14 is shaped and configured to mimic and contour to this squat position whilst giving consideration to the reduced range of mobility limitations a user with physical disability may have. The back support 14 contours in both the longitudinal and transverse planes, meaning it contours to the back of a user when it is flexed into the C-shape curve (longitudinal) and contours to both sides of the trunk of a user to provide lateral support and prompt the user to remain in a midline position.

Optionally, the back support 14, leg support features 12, and base portion 11 are integrally formed or attached to each other such that they may form a seat 10 in the in-use configuration but may be unfolded therefrom to a flattened state if required.

The leg support features 12 comprise thigh support portions 15 shaped and dimensioned to support the thighs of a user seated on the seat 10. The apparatus 10 comprises a foot support element 16 configured to support the feet of a user seated on the seat. The foot support element 16 may form part of the apparatus 10, or alternatively may be provided on a supporting structure such as a frame 17, which will be later discussed. It should be understood that the foot support element 16 is not essential as the aforementioned portions of the seat 10 are sufficient alone to encourage a user seated thereon into the squat position. However, the foot support element 16 may provide additional assistance/comfort to the user. The apparatus also comprises lateral side supports 18 which extend from the base portion 11 and are shaped and dimensioned to laterally support a user seated on the seat 10. In a preferred embodiment, the lateral supports 18 are formed by contoured sides 18 of the base portion to support the sides of a user in the in-use configuration.

Figure 9:
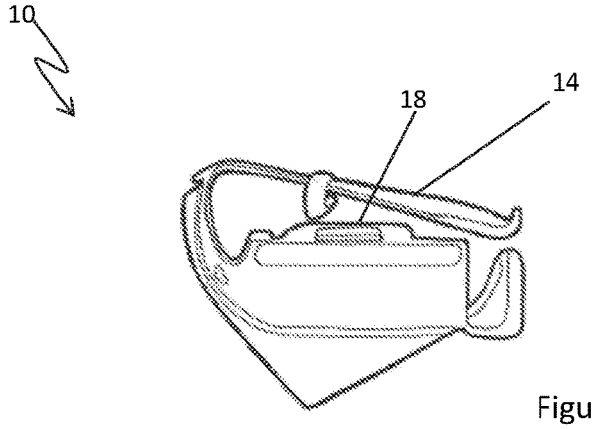
FIG. 9 is a side view of a seat of a posturally supportive toilet seat apparatus in a stowed configuration.

The apparatus 10 also has stowed configuration, best viewed in FIG. 9, wherein the back support 14 is folded towards the leg support features 14 such that the back support 14 extends generally over an upper surface of the base portion 11. This stowed configuration makes storage and transport of the toilet seat apparatus easier, thus facilitates use of the toilet seat in locations where no specialised toilet facilities are available. In the stowed configuration, the lateral side supports 18 may also be foldable towards the upper surface of the base portion 11 such that the seat 10 forms a compact overall size in the stowed position. The seat 10 is deployable between the in use and stowed configurations by folding the back support 14 towards the upper surface of the base portion 11 and securing the back support 14 in place using a strap or the like. Alternatively, the apparatus 10 may be foldable such that the back support 14 remains in place in the stowed configuration without physical retention.

The base portion 11, back support 14, and the leg support features 12 comprise contoured user facing surfaces 19 shaped such that the anatomy of a user is supported in the squat position as described above. The contoured user facing surfaces 19 ensure the curvature at the base of the spine, the soft tissue of the bottom and the thigh are all supported in the squat position. As the shape contours to the bottom of a user, the contoured user facing surfaces 19 transition into flat plane with approximately 40 degrees of ramping. By anatomically shaping the contoured user facing surfaces 19 to meet the curvature of the body as well as adding ramping, this helps stabilise the pelvis. Stabilising the pelvis promotes the stability and positioning of the trunk, head and upper and lower extremities, which is a key concept in paediatric special seating. The thigh support portions 15 are shaped to ensure a users thighs are supported whilst in the squatted position. This enables loading to occur across the soft tissues of the bottom and across the thigh to ensure the user remains fully relaxed when evacuating. In addition, this greater area of the users anatomy which takes loading in the squatted position results in a lower risk of skin breakdown or markings. The thigh support portions 15 comprise inner and outer thigh support surfaces 20, 21 shaped and dimensioned to support respective inner and outer thighs of a user. In a preferred embodiment, the thigh support portions 15 are formed by contouring of the base portion to form two leg receiving channels 22, 23 into which the legs of a user may be located. When in the in-use configuration, the base 24 of the leg receiving channels 22, 23 support the rear of the users' upper legs when in the squat position, and help to maintain the user in said squat position. The lateral side supports 18 may be extensions of the outer portions 21 of the leg receiving channels 22, 23. The inner portions 20 of the leg receiving channels form adducting features which encourage adequate separation of the legs of a user. The leg support features may also comprise a pommel portion 31 locatable at the front of the apparatus 10.

The seat 10 has an adjustment mechanism 26 operable to adjust the positioning of the back support 14 relative to the leg support features 12. The adjustment mechanism 16 is operable between the back support and the leg support features 12 or lateral side supports 18. In a preferred embodiment, an adjustment mechanism 26 is operable between each lateral side 27, 28 of the back support 14 such that said lateral sides 27, 28 are independently adjustable/positionable relative to the leg support features 12. In this manner, the back support may be asymmetrically positioned to provide support for users having anatomy or muscular issues which cause leaning to one side when seated. For example, where a user leans towards a first lateral side 27 of the back support 14, the adjustment mechanism 26 on the first lateral side 27 of the back support 14 may be adjusted such that the back support 14 is pulled closer to the leg support features 12 on this lateral side 17 when compared to the opposing lateral side 28. In cases where leaning is not an issue, the adjustment mechanisms 16 are utilised to adjust each lateral side 27, 28 of the back support equally such that each lateral side 27, 28 is positioned similarly relative to the leg support features 12. In either case, the adjustment mechanisms 26 adjust the back support 14 such that the positioning thereof relative to the leg support features 12 suits the anatomy and proportions of the user and, taking account of said anatomy, encourages the user into the squat position. The adjustment mechanisms 26 may be any suitable mechanism which would be known to the skilled person such as but not limited to a ratcheting mechanism or a length adjustable strap. In the preferred embodiment, the adjustment mechanisms 26 are operable between the back support and the lateral side supports 18, as can be seen in FIGS. 7 and 8. Advantageously, the adjustment mechanisms may also be adjusted, or disengaged, such that the back support may be moved away from the leg support features 12, thus a user may be more easily removed from the seat 10.

In the preferred embodiment as shown in FIGS. 1 to 6, the seat 10 is mountable on a supporting frame 17 which is vertically adjustable. The frame comprises four legs 29 which extend from the ground to a seat engagement section 30 of the frame 17. The legs 29 are telescoping legs 29 such that extension thereof raises the seat engagement portion 30 of the frame 17 to a desired height. The telescoping legs 29 are of a commonly known type and are securable at various lengths, said lengths placing the seat engagement section 30 within a range of heights such that it is suitable for all intended users, and/or for any toileting infrastructure which the apparatus may be located above. In the preferred case, the telescoping legs 29 provide at least three height settings, namely separate height settings which provide a distance between the floor on which the frame is placed and the buttocks of a user of approximately 295 millimetres, 450 millimetres, and 530 millimetres respectively. The height settings are designed such that they permit the use of the apparatus above a standard children's potty, above a standard UK or US toilet, and above a UK or US disabled toilet. In a preferred embodiment, the telescoping legs comprise first and second generally tubular portions 35, 36, the first portion 35 being slidable within the second portion 36, and the portions 35, 36 being securable to each other via a locking component 37 such that the secured portions 35, 36 form a leg 29 having a desired length. In a preferred embodiment, the locking component may comprise or be supplemented by a releasable locking plunger arrangement 41. The locking plunger arrangement comprises a plunger 42 which is operable to pass through bores (not shown) formed in the first and second generally tubular portions 35, 36 such that relative movement is prevented therebetween. The bores in the first and second generally tubular portions 35, 36 are formed for receiving the plunger 42 and are alignable such that the plunger 41 may pass through both bores and multiple bores may be formed in the lower tubular portion 36 such that alignment of different bores of the lower tubular portion 36 with the bore of the upper tubular portion 35 permits locking of the portions relative to one another in different positions and thus permits the telescoping legs 29 to be locked at different lengths. The plunger and bores form a deadlock arrangement providing additional safety for a user. The plunger 41 may be a biased plunger such that it is biased towards the bores by a spring or the like. The plunger locking plunger arrangement may be provided with stop features to prevent unintended removal of the plunger 42 from the frame. Additionally, the seat is slidably mountable to the frame 17 at the seat engagement section 30 such that the seat 10 is slidable in forward and rearward directions. The seat 10 is also lockabe to the frame 17 in a desired position, preferably via a cam mechanism (not shown) locatable on the frame 17 and operable between the frame and the seat 10. In this case, reference to forward and rearward movement of the seat 10 is in relation to the forward and rearward facing directions of a user when positioned on the seat 10. The slideable engagement between the seat 10 and the frame is accomplished via any one of a variety of slidable engagement mechanisms which would be known to a person skilled in the art, such as but not limited to a sliding bar mechanism or mutually engagable slots formed on the seat 10 and the seat engagement section 30 of the frame 17. In a preferred case, the seat 10 is slidable a distance of 52-55 along the seat engagement section 30 to allow for the apparatus to accommodate a variety of users of different sizes and anatomy.

The frame 17 is preferably adapted to receive a collection pan 33. The collection pan 33 is removably mountable to the frame 17 such that the collection pan 33 is mountable beneath the aperture 13 of the seat 10. The collection pan may therefore collect waste deposited thereinto, and may be removed for disposal of said waste, and for cleaning. The collection pan 33 may be slidable onto the seat engagement portion 30 of the frame 17 and may have a rear engagement member 38 which engages with the upper portion of the seat engagement portion 30 to provide added stability when in use. The collection pan 33 and seat engagement portion 30 of the frame 17 may have corresponding tracks or slots formed therein to provide the slidable engagement therebetween, or alternatively such slidable engagement can be facilitated by any of a number of methods known to the skilled person. In some cases, the collection pan 33 is not utilised, and the frame is placed over an existing toilet (not shown) such that waste which travels through the aperture 13 falls into the existing toilet.

The frame is manufactured from a lightweight material and, due to its open sided nature, provides easy access for a carer or medical professional to the buttocks of a user. The frame 17 is deployable between an in use configuration and a stowed configuration, thus allowing for easy storage and transport when not in use. The frame 17 may be foldable or may be disassembled into the stowed configuration and the skilled person would be aware of standard methods for making portions of the frame foldable or capable of disassembly. In a preferred embodiment, the foot support element 16 is movably mountable to the frame 17 such that the distance between an underside of the seat 10 and the foot support element 16 is adjustable. The foot support element 16 may be removable and positionable in a plurality of positions on the frame 17 such that it may support the feet of a user on the seat 10 in the desired manner. Alternatively, the foot support element is engagable with the frame 17 via a movement mechanism (not shown), the movement mechanism being actuatable to move the foot support element 16 towards or away from the seat 10. The movement mechanism may be any suitable mechanism known to the skilled person. The foot support element 16 is preferably attachable to the front legs 34 of the frame 17 and forms a step or ledge upon which the feet of a user may be placed. Advantageously, the foot support element 16 supports the feet of a user in a position which further encourages the user into the squat position when seated on the seat 10. In a preferred embodiment, the foot support element can be moved in the axial direction of the front legs 34 of the frame a distance of at least approximately 120 millimetres to allow for the apparatus to accommodate a variety of users of different sizes and anatomy. In the preferred case, the foot support element is locatable in at least five separate positions on the frame 17. The foot support element 16 may also be provided with straps 40 which act to secure the feet of a user to the foot support element 16 when the user is seated on the seat 10.

Figure 13:
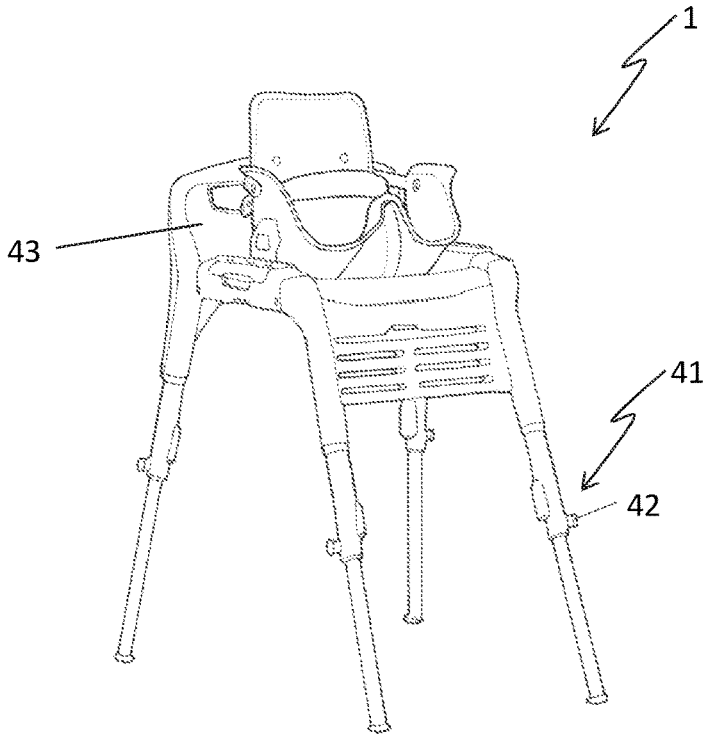
FIG. 13 is a perspective view of a posturally supportive toilet seat apparatus comprising a releasable locking plunger arrangement 41 and an alternative rear cover/support.
Figure 14:
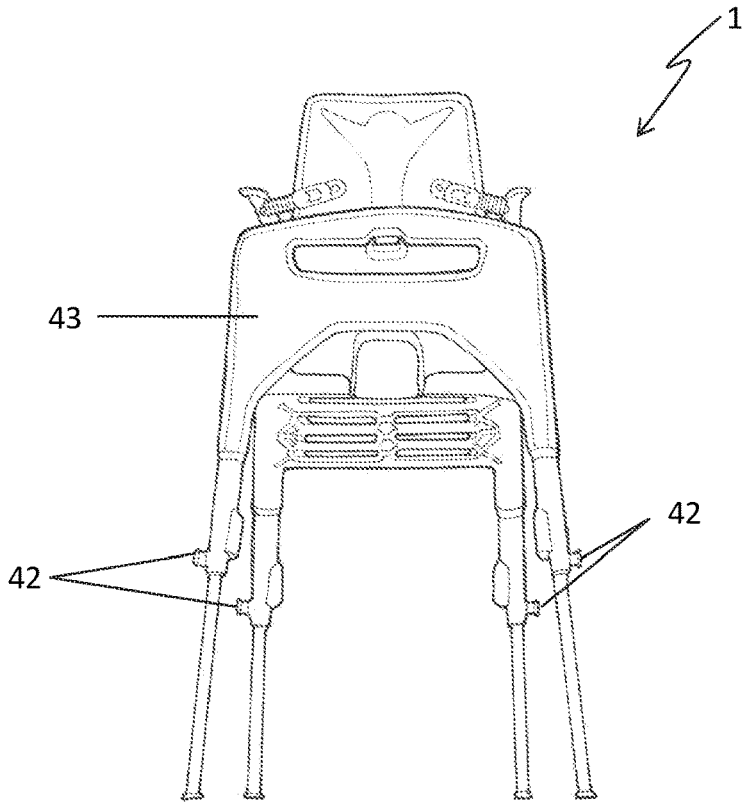
FIG. 14 is a rear view of the posturally supportive toilet seat apparatus of FIG. 13.

As can be seen in FIGS. 13 and 14, the apparatus comprises a rear cover/support 43 which is sized and dimensioned to provide additional bracing/support to the seat 10 during use. The rear cover/support 43 provides additional support in particular when dynamic movements by a user located on the seat 10 are experienced.

Figure 10:
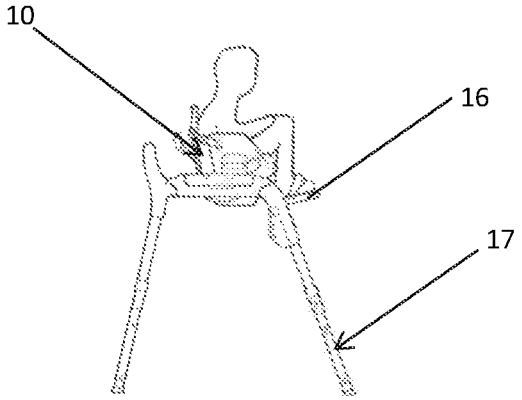
FIG. 10 is a side view of a seat of a posturally supportive toilet seat apparatus in use by a user of a first size.
Figure 11:
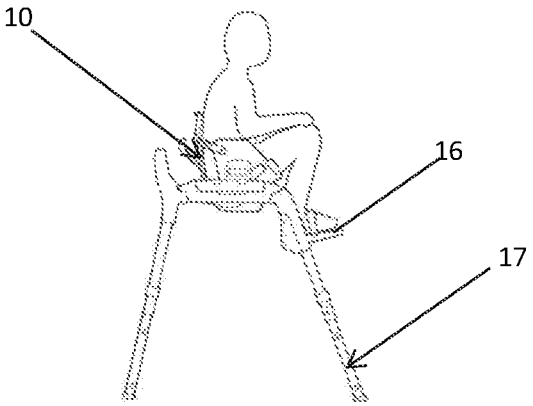
FIG. 11 is a side view of a seat of a posturally supportive toilet seat apparatus in use by a user of a second size.
Figure 12:
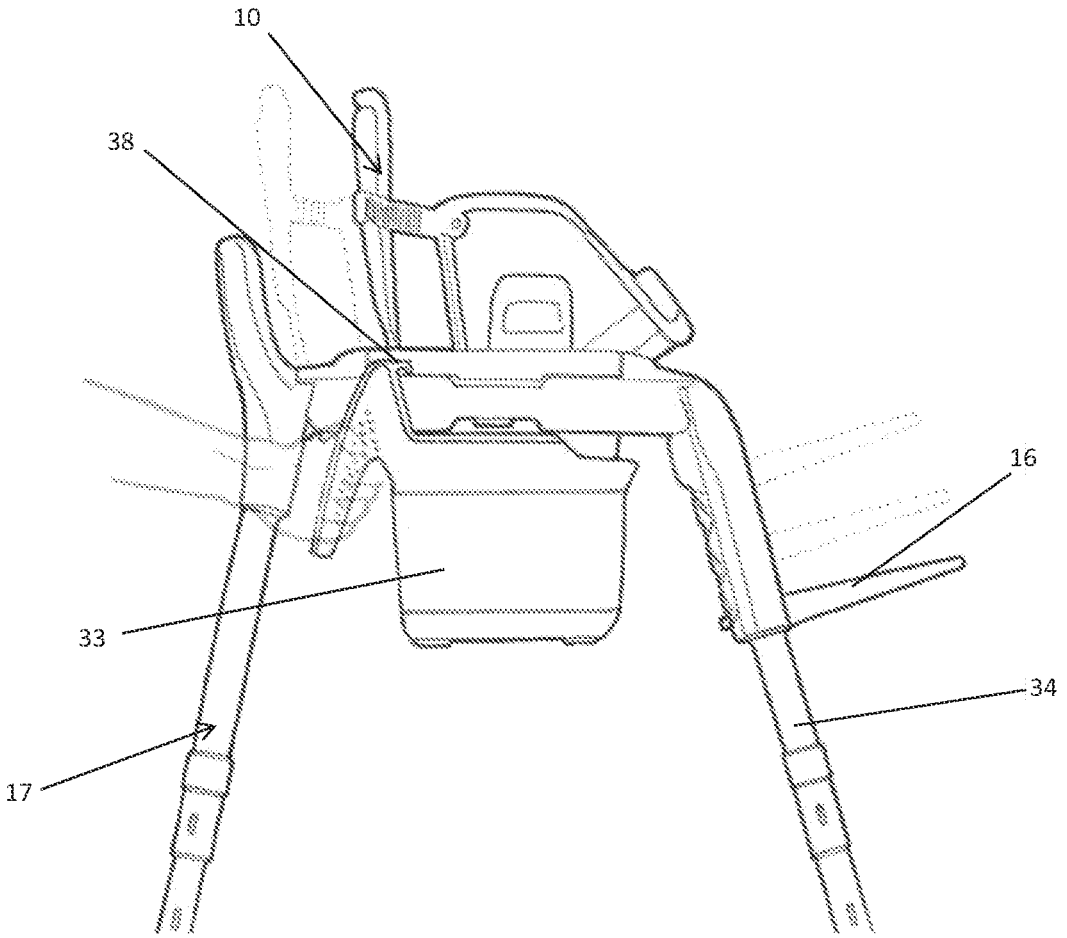
FIG. 12 is a side view of a seat of a posturally supportive toilet seat apparatus showing the movable nature of a seat and a foot support element relative to a frame thereof, and showing a removable collection pan.

As can best be viewed in FIGS. 10 and 11, the aforementioned adjustable elements of the apparatus facilitate use by users of varying sizes and ages. For example, FIG. 10 shows the apparatus in use by a child aged approximately 2 years old. By downwards adjustment of the foot support element 16, and movement of the to seat 10 rearwards relative to the frame 17, the apparatus may be adapted to suit a larger child of approximately 6 years old, as shown in FIG. 11.

The apparatus may also be provided with a safety harness to secure the user when seated on the seat 10. The skilled person would be aware of various typical safety harness and strapping arrangements which could be utilised to achieve this aim. Similarly, ankle straps may be provided to retain the legs of a user in place when seated on the seat 10. The apparatus may also be provided with a changing mat (not shown) which may be used before use of the toilet seat apparatus 1 for preparing the user for said use, or thereafter to clean the user.

The apparatus encourages an anatomically favoured position to encourage voiding; the squat position optimises the max flow rate and effective bowel evacuation. Moreover, the apparatus allows support of a user in the squat position even when specially adapted bathroom facilities which comprise in-built infrastructure are not available, and is easily transportable.

The invention is not limited to the embodiment(s) described herein but can be amended or modified without departing from the scope of the present invention.

The invention claimed is:

1. A posturally supportive toilet seat apparatus comprising:

a seat, the seat comprising;

a base portion comprising leg support means, the base portion having an aperture formed therein;

back support means; and wherein the back support means and leg support means are shaped, dimensioned, and/or adjustable/positionable relative to each other in an oblique relationship such that, in an in use configuration, the thighs and torso of a user seated on the seat are encouraged to form an acute interior angle therebetween with knees locatable above hips, resulting in the user adopting a squat position, wherein relative to a seated position the heels of a user in the squat position are raised to a position closer to the buttocks by the bending of the knees, and the pelvis tilts backwards.

2. The posturally supportive toilet seat apparatus of claim 1, wherein the leg support means comprise thigh support portions shaped and dimensioned to support the thighs of a user seated on the seat.

3. The posturally supportive toilet seat apparatus of claim 2, wherein the thigh support portions comprise inner and outer thigh support surfaces shaped and dimensioned to support respective inner and outer thighs of a user.

4. The posturally supportive toilet seat apparatus of claim 1, wherein the apparatus comprises a foot support element configured to support the feet of a user seated on the seat.

5. The posturally supportive toilet seat apparatus of claim 1, further comprising lateral side support means which extend from the base portion and are shaped and dimensioned to laterally support a user seated on the seat.

6. The posturally supportive toilet seat apparatus of claim 5, wherein the seat comprises a stowed configuration wherein the back support means is folded towards the leg support means such that the back support means extends generally over an upper surface of the base portion.

7. The posturally supportive toilet seat apparatus of claim 6, wherein, in the stowed configuration, the lateral side support means are foldable towards the upper surface of the base portion.

8. The posturally supportive toilet seat apparatus of claim 6, wherein the seat is deployable between the in use and stowed configurations.

9. The posturally supportive toilet seat apparatus of claim 1, wherein the base portion, back support means, and/or the leg support means comprise contoured user facing surfaces shaped such that the anatomy of a user is supported in the squat position.

10. The posturally supportive toilet seat apparatus of claim 1, comprising an adjustment mechanism operable to adjust the positioning of the back support means relative to the leg support means.

11. The posturally supportive toilet seat apparatus of claim 1, wherein the back support means and/or leg support means are independently adjustable/positionable.

12. The posturally supportive toilet seat apparatus of claim 1, wherein each lateral side of the back support means is independently adjustable/positionable relative to the leg support means.

13. The posturally supportive toilet seat apparatus of claim 1, wherein the seat is mountable on a supporting frame.

14. The posturally supportive toilet seat apparatus of claim 13, wherein the frame is deployable between an in use configuration and a stowed configuration and/or wherein the frame comprises means for vertical adjustment.

15. The posturally supportive toilet seat apparatus of claim 13, wherein the seat is slidably mountable to the frame such that the seat is slidable in forward and rearward directions.

16. The posturally supportive toilet seat apparatus of claim 13, wherein the frame comprises a collection pan removably mountable to the frame such that the collection pan is mountable beneath the aperture of the seat.

17. The posturally supportive toilet seat apparatus of claim 13, wherein a foot support element is movably mountable to the frame such that the distance between an underside of the seat and the foot support element is adjustable.

18. A frame for a posturally supportive toilet seat apparatus, a seat being movably mountable to the frame, the seat comprising; a base portion comprising leg support means, the base portion having an aperture formed therein; back support means; and wherein the back support means and leg support means are shaped, dimensioned, and/or adjustable/positionable relative to each other in an oblique relationship such that, in an in use configuration, the thighs and torso of a user seated on the seat are encouraged to form an acute interior angle therebetween with knees locatable above hips, resulting in the user adopting a squat position, wherein relative to a seated position the heels of a user in the squat position are raised to a position closer to the buttocks by the bending of the knees, and the pelvis tilts backwards.

19. A posturally supportive toilet seat kit comprising:

a posturally supportive toilet seat comprising: a seat, the seat comprising a base portion, the base portion comprising leg support means and having an aperture formed therein; back support means; wherein the back support means and leg support means are shaped, dimensioned, and/or adjustable/positionable relative to each other in an oblique relationship such that, in an in use configuration, the thighs and torso of a user seated on the seat are encouraged to form an acute interior angle therebetween with knees locatable above hips, resulting in the user adopting a squat position, wherein relative to a seated position the heels of a user in the squat position are raised to a position closer to the buttocks by the bending of the knees, and the pelvis tilts backwards; the kit further comprising:

a frame, the seat being mountable to the frame.

20. The posturally supportive toilet seat kit of claim 19, further comprising a collection pan removably mountable to the frame and/or further comprising a changing mat configured for changing/cleaning of the user.

* * * * *